US006817122B1

(12) United States Patent
Bokis

(10) Patent No.: US 6,817,122 B1
(45) Date of Patent: Nov. 16, 2004

(54) COMBINED GREETING CARD AND DECORATIVE CANDLE DISPLAY

(76) Inventor: Peter Bokis, 67 Citadel Vista Close NW, Calgary, Alberta Province (CA), T3G 4W7

( * ) Notice: Subject to any disclaimer, the term of this patent is extended or adjusted under 35 U.S.C. 154(b) by 47 days.

(21) Appl. No.: 10/272,098

(22) Filed: Oct. 16, 2002

(51) Int. Cl.[7] ..... B42D 15/00

(52) U.S. Cl. ..... 40/124.01; 40/124.02; 40/124.06; 40/124.191

(58) Field of Search ..... 40/124.191, 124.06, 40/124.19, 124.01, 124.02; 431/126, 288; 425/803; 206/457, 232, 459.5, 461

(56) References Cited

U.S. PATENT DOCUMENTS

| | | | | | |
|---|---|---|---|---|---|
| 1,714,774 | A | | 5/1929 | Goldsmith | |
| 1,863,416 | A | * | 6/1932 | Root | 431/288 |
| 1,937,393 | A | * | 11/1933 | Root | 431/126 |
| 3,077,981 | A | | 2/1963 | Gaspard | 206/47 |
| 4,035,937 | A | | 7/1977 | Rosenfeld | 40/16.4 |
| 4,584,213 | A | | 4/1986 | Rentowl | 428/23 |
| 4,840,275 | A | | 6/1989 | Faiola et al. | 206/423 |
| 5,038,930 | A | | 8/1991 | Holtkamp, Jr. | 206/232 |
| D319,843 | S | | 9/1991 | Thornell | D19/2 |
| 5,632,615 | A | | 5/1997 | DeGarmo | 431/288 |
| 5,693,277 | A | | 12/1997 | Widmer | 264/153 |
| 6,106,023 | A | | 8/2000 | Sud et al. | 283/117 |
| 6,393,743 | B1 | * | 5/2002 | Whitworth | 40/124.01 |
| 6,449,891 | B1 | * | 9/2002 | Miska | 40/789 |
| 6,550,617 | B1 | * | 4/2003 | Elva | 206/457 |

* cited by examiner

*Primary Examiner*—Mark T. Le
(74) *Attorney, Agent, or Firm*—Sturm & Fix LLP

(57) ABSTRACT

A combined greeting card/candle arrangement (10) including a greeting card member (20) having a front face (21) adapted to releasably receive a candle unit (12) including a plurality of different colored wax sheets (30) (30') (30") having different sizes wherein the largest of the wax sheets (30) has a wick element (36) embedded therein; and, a plurality of decorative members (40) releasably associated with selected portions of the wax sheets (30) (30') (30") which may be rolled together to form a tapered candle (50).

13 Claims, 1 Drawing Sheet

COMBINED GREETING CARD AND DECORATIVE CANDLE DISPLAY

BACKGROUND OF THE INVENTION

CROSS REFERENCE TO RELATED APPLICATIONS

Not applicable.

1. Field of the Invention

The present invention relates to the field of greeting cards in general and in particular to a greeting card in combination with a diverse article such as a candle or the like.

2. Description of Related Art

As can be seen by reference to the following U.S. Pat. No. 3,077,981; DES. 319,843; U.S. Pat. Nos. 1,714,774; 4,035,937; and, U.S. Pat. No. 5,632,615, the prior art is replete with myriad and diverse greeting cards combined with diverse articles such as candles.

While all of the aforementioned prior art constructions are more than adequate for the basic purpose and function for which they have been specifically designed, they are uniformly deficient with respect to their failure to provide a simple, efficient, and practical greeting card and candle combination wherein the candle is comprised of a plurality of components that in their unassembled state form a background for an image that appears on the face of the greeting card.

Unfortunately, the prior art greeting card/candle combinations employ whole candle elements which, due to their bulky external configurations, are prone to damage in the mail since they do not have the slim profile that most automated mail handling systems require for processing flats.

As a consequence of the foregoing situation, there has existed a longstanding need for a new and improved combined greeting card and decorative candle display wherein the components of the candle comprise a plurality of generally flat rectangular contoured elements to initially produce a slim profile for mailing and which are combinable with one another to produce a tapered candle once the recipient has the greeting card in their possession and the provision of such an arrangement is the stated objective of the present invention.

BRIEF SUMMARY OF THE INVENTION

Briefly stated, the combined greeting card and candle arrangement that forms the basis of the present invention comprises in general a card unit, a candle unit adapted to be received by the greeting card unit and a decorative unit which is releasably associated with the candle unit.

As will be explained in greater detail further on in the specification, the candle unit comprises the crux of this invention and includes a plurality of different sized and different colored wax sheets which originally form a removable background for the front of the card unit and a support surface for the decorative unit; but, which more importantly comprise the components of a tapered finished candle member wherein the largest of the wax sheets has a wick element embedded along one edge which winds up being axially disposed relative to the finished candle member.

In addition, the front face of the card unit is provided with a plurality of slots which releasably receive selected portions of the multiple, generally flat layers of the wax sheets; wherein, the different colored wax sheets constitute a background and a support surface for the decorative unit which are releasably attached thereto.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
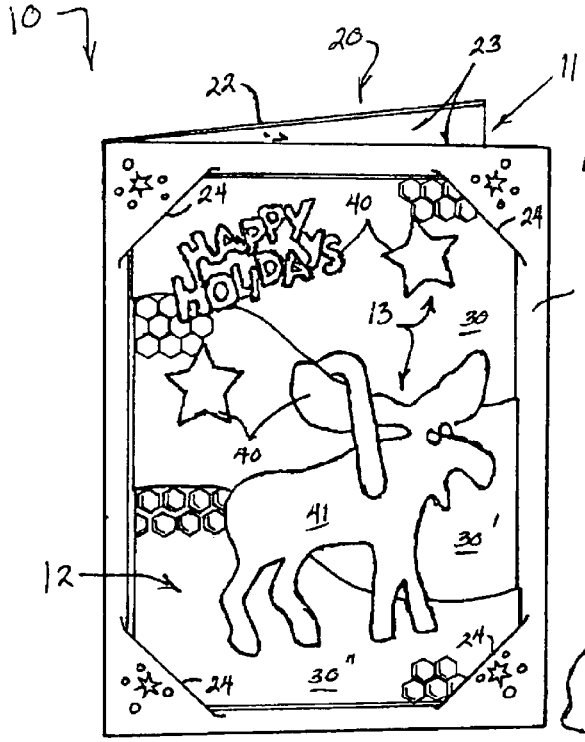
FIG. 1 is a perspective view of the greeting card/candle arrangement in its assembled mode.

As can be seen by reference to the drawings, and in particular to FIG. 1, the combined greeting card/candle arrangement that forms the basis of the present invention is designated generally by the reference number 10. The arrangement 10 comprises in general a card unit 11, a candle unit 12 and a decorative unit 13. These units will now be described in seriatim fashion.

As shown in FIG. 1, the card unit 11 comprises a folded stock card member 20 having a front face 21, a rear face 22, and a pair of interior faces 23 wherein at least one of the interior faces 23 contains a printed or handwritten greeting or the like (not shown).

In addition, in the preferred embodiment of the invention, the front face 21 of the card member 20 is provided with a plurality of angled slots 24 disposed adjacent to, but spaced from, the four corners of the front face 21 of the card member 20 for reasons that will be explained later on in the specification.

Figure 3:
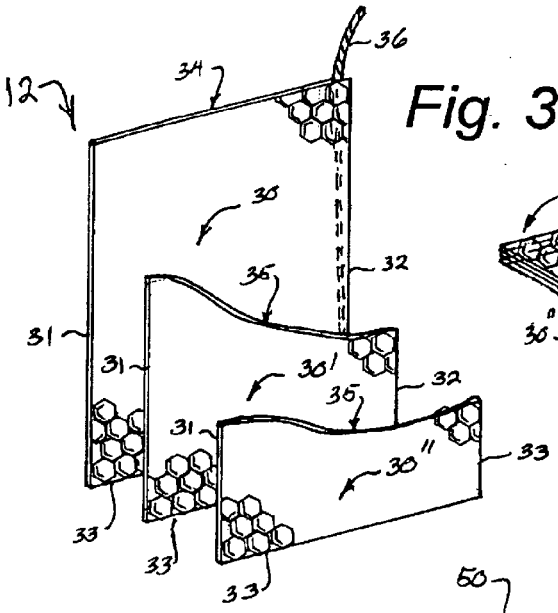
FIG. 3 is an exploded perspective view of the components of the candle unit.
Figure 4:
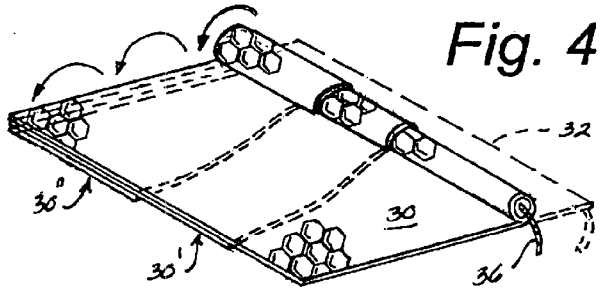
FIG. 4 is a perspective view showing the candle components partially assembled.
Figure 5:
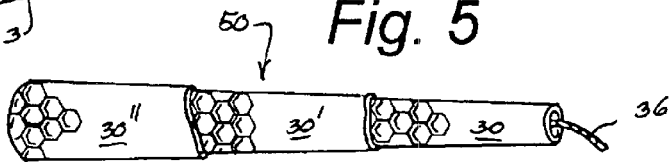
FIG. 5 is a perspective view of the fully assembled candle unit.

Turning now to FIGS. 3 through 5, it can be seen that the candle unit 12 comprises a plurality of different sized contoured wax sheets 30 30' 30" which diminish in size and which all share in common a pair of opposed straight vertical sides 31 32 and a straight horizontal bottom edge 33; wherein, the largest of the wax sheets 30 has a straight horizontal top edge 34 and the smaller sized wax sheets 30' 30" have a contoured top edge 35.

In addition, the largest wax sheet 30 is further provided with an embedded wick element 36 disposed adjacent to one of the straight vertical sides 32 and each of the wax sheets 30 30' and 30" is fashioned from wax of a different color for reasons that will be explained shortly.

Figure 2:
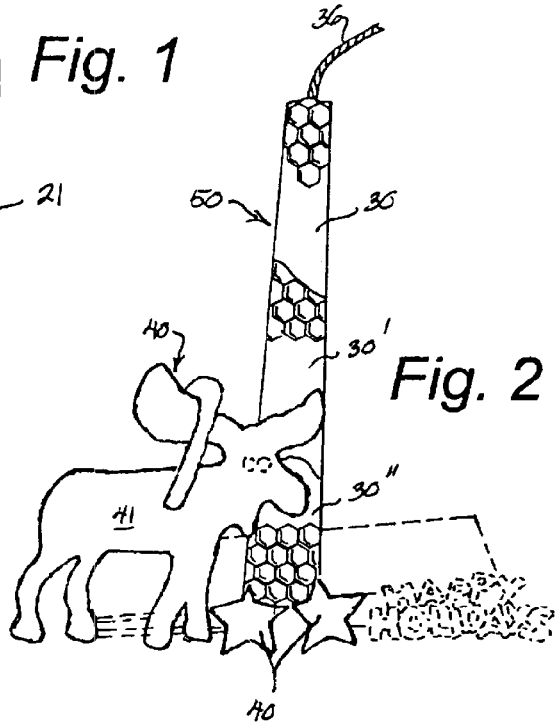
FIG. 2 is a perspective view of the greeting card/candle arrangement in its segregated mode.

Furthermore, as shown in FIGS. 1 and 2, the decorative unit 13 comprises a plurality of generally flat contoured decorative members 40 fabricated from generally soft flexible material 41; wherein, the various decorative members 40 are adapted to be releasably attached to the front faces of the wax sheets 30 30' 30" such as by light adhesives or the like.

As can best be appreciated by reference to FIG. 1, the generally flat, slim profile of the wax sheets 30 30' and 30" allows their lower corners to be captively received in the lower slots 24 on the front face 21 of the card member 20; wherein, the upper corners of the largest wax sheet 30 are likewise captively received in the upper slots 24; and, the smaller dimension wax sheets 30' 30" adhere to one another and the largest wax sheet 30 by virtue of the inherent tackiness of the wax material.

Furthermore, as was mentioned previously, each of the wax sheets 30 30' 30" is fabricated from wax of a different color so that the staggered arrangement of the wax sheets 30 30' 30" provides a contoured multi-colored background for the decorative members 40.

By now it should be appreciated that once a person receives the combined greeting card/candle arrangement 10 of FIG. 1, and has read the greeting on at least one of the interior faces 23 of the card member 20 the combined arrangement 10 may be segregated into its respective units 11 12 and 13.

At this point, as depicted in FIGS. 4 and 5, the overlapping wax sheets are rolled together starting from the vertical edge 32 having the embedded wick element 36 to produce the tapered multi-layered wax candle designated generally as 50 and depicted in FIGS. 2 and 5.

As can also be appreciated by reference to FIG. 2, the decorative members (40) may also be re-arranged around and/or on the finished candle to produce an aesthetically pleasing display that maintains the theme set forth in the original combined greeting card/candle arrangement 10 depicted in FIG. 1.

As can also be appreciated by reference to FIGS. 1 through 5, in the preferred embodiment of the invention, the wax sheets 30 30' and 30" are provided with a raised honeycomb array to both minimize the surface contact between adjacent wax sheets 30 30' etc., and to provide structural integrity and thickness to the finished multi-layered wax candle 50.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A greeting card/candle arrangement comprising:

a card unit including a greeting card member having a front face and at least one additional face bearing a greeting; and, a candle unit including a plurality of generally thin wax sheets releasably connected to one another and releasably associated with one of the faces of the greeting card member; wherein, a selected one of the plurality of wax sheets is provided with an elongated wick element embedded therein; each of the wax sheets has a pair of straight vertical edges and at least one straight horizontal edge; and, wherein, each of the plurality of wax sheets has a different size, and one of the vertical edges on each sheet is aligned with one of the vertical edges of the remaining sheets.

2. The arrangement as in claim 1; wherein, the greeting card member is fabricated from folded stock and has a front face, a rear face, and a pair of opposed interior faces.

3. The arrangement as in claim 2; wherein, at least one of the faces of the card member is provided with a plurality of slots dimensioned to receive selected portions of the plurality of wax sheets.

4. The arrangement as in claim 1; wherein, each of the plurality of wax sheets is fabricated from wax of a different color.

5. The arrangement as in claim 3; wherein, each of the plurality of wax sheets fabricated from wax of a different color.

6. The arrangement as in claim 1; wherein, the largest of the wax sheets has the wick element embedded therein.

7. The arrangement as in claim 6, wherein, each of the plurality of wax sheets is fabricated from wax of a different color.

8. The arrangement as in claim 1 further comprising:

a decorative unit including a plurality of contoured decorative members adapted to be releasably associated with selected portions of the plurality of wax sheets.

9. The arrangement as in claim 1; wherein, each of the plurality of wax sheets is provided with a honeycomb contour.

10. A greeting card/candle arrangement comprising:

a card unit including a greeting card member having a front face and at least one additional face bearing a greeting; and, a candle unit including a plurality of generally thin, wax sheets releasably connected to one another and releasably associated with one of the faces of the greeting card member wherein, a selected one of the plurality of wax sheets is provided with an elongated wick element embedded therein; each of the wax sheets has a pair of straight vertical edges and at least one straight horizontal edge; and wherein, each of the plurality of wax sheets has a different size and selected ones of the plurality of sheets have a non-linear contoured upper edge.

11. The arrangement as in claim 10; wherein, the largest of the wax sheets is provided with said elongated wick element.

12. The arrangement as in claim 11; wherein, the tallest of the wax sheets is provided with an additional linear edge.

13. The arrangement as in claim 12; wherein, said additional linear edge is horizontal.

* * * * *